US005672838A

United States Patent [19]

Lee et al.

[11] Patent Number: 5,672,838

[45] Date of Patent: Sep. 30, 1997

[54] ACCOMPANIMENT DATA FORMAT AND VIDEO-SONG ACCOMPANIMENT APPARATUS ADOPTING THE SAME

[75] Inventors: Deok-hyun Lee, Seoul; Hong-soon Park, Suwon, both of Rep. of Korea

[73] Assignee: Samsung Electronics Co., Ltd., Kyungki-Do, Rep. of Korea

[21] Appl. No.: 435,780

[22] Filed: May 5, 1995

[30] Foreign Application Priority Data

Jun. 22, 1994 [KR] Rep. of Korea ..... 94-14325

[51] Int. Cl.[6] ..... G10H 7/00

[52] U.S. Cl. ..... 84/645; 434/307 A

[58] Field of Search ..... 84/609, 610, 634, 84/645, 600, 601; 434/307 A

[56] References Cited

U.S. PATENT DOCUMENTS

| | | | |
|---|---|---|---|
| 5,208,413 | 5/1993 | Tsumura et al. | 84/610 X |
| 5,233,438 | 8/1993 | Funahashi et al. . | |
| 5,247,126 | 9/1993 | Okamura et al. | 84/645 X |
| 5,321,200 | 6/1994 | Yamamoto | 84/645 |
| 5,410,100 | 4/1995 | Kim | 84/645 |
| 5,499,922 | 3/1996 | Umeda et al. . | |

*Primary Examiner*—William M. Shoop, Jr.
*Assistant Examiner*—Jeffrey W. Donels
*Attorney, Agent, or Firm*—Sughrue, Mion, Zinn, Macpeak & Seas, PLLC

[57] ABSTRACT

A video-song accompaniment apparatus displaying a lyrics signal sequence in accordance with an accompaniment signal sequence includes a controller responsive to lyrics display control information which is loaded on a channel message of a selected instrument of the accompaniment information. The lyrics display control information has a display flag for instructing output of the lyrics for a next measure by a lyrics signal generator, a color conversion flag permitting successive conversion of the characters of a lyrics signal sequence output by the lyrics signal generator from one color to another, and an erasure flag for instructing erasure of the previously-displayed lyrics output by the lyrics signal generator. Preferably, the display of the lyrics signal sequence is controlled according to the lyrics display control information read out of an accompaniment information memory by the controller during reproduction. The video-song accompaniment apparatus permits generation of the lyrics signal sequence in synchronization with an accompaniment signal sequence by controlling the lyrics display using a channel message of a Musical Instrument Digital Interface (MIDI) signal.

6 Claims, 3 Drawing Sheets

ACCOMPANIMENT DATA FORMAT AND VIDEO-SONG ACCOMPANIMENT APPARATUS ADOPTING THE SAME

BACKGROUND OF THE INVENTION

1. Field of the Invention

The present invention relates to a video-song accompaniment apparatus, and, more specifically, to a data format having lyrics display control information embedded in the accompaniment information. A video-song accompaniment apparatus adopting the above-mentioned data format, which permits the apparatus to display lyrics in accordance with an accompaniment signal and a corresponding operating method are also disclosed.

2. Brief Description of Related Art

A video-song accompaniment apparatus, commonly called a karaoke machine, displays lyrics on a video display device according to an accompaniment signal. This apparatus enables the user to sing a displayed lyrics sequence for a selected song in time to the accompaniment.

Previous devices of this type have employed laser disks for storing both the lyrics and the accompaniment information. Recently, a new form of the video-song accompaniment apparatus has appeared, one which records or stores a sampled analog accompaniment signal and the associated lyrics information using a compact disk and a semiconductor memory, respectively.

A conventional laser disk records lyrics information onto video information, so there is no need for an additional process for controlling color conversion of, for example, a character appearing in the lyrics information in order to show the lyrics in accordance with the analog accompaniment signal. However, a video-song accompaniment apparatus using digital accompaniment data requires additional lyrics display control to maintain synchronism between the accompaniment signals and the characters of the lyrics information due to the fact that they are separately recorded. However, the conventional video-song accompaniment apparatus employing digital accompaniment data, uses a method of coloring each character of the lyrics information successively in response to the tempo of the selected song in order to synchronize a reproduced accompaniment signal sequence to a lyrics signal sequence. In other words, the color of each character or symbol of the lyrics information displayed on a screen is changed successively at a speed determined according to the tempo of a corresponding song.

Such a method simplifies the management of lyrics information. However, that method has an attendant problem characterized by an inconsistency or mismatch between the accompaniment signal sequence and the lyrics signal sequence. This problem is due to the fact that note duration is different from one note to another.

SUMMARY OF THE INVENTION

The principal object of and motivation for the present invention are to solve the above-described problem.

An object of the present invention is to provide an accompaniment data format having lyrics display control information, by which a lyrics signal sequence can be displayed in accordance with an accompaniment signal sequence.

Another object of the present invention is to provide a video-song accompaniment apparatus which can display a lyrics signal sequence in accordance with an accompaniment signal sequence.

Still another object of the present invention is to provide a method for operating a video-song accompaniment apparatus so as to permit display of a lyrics signal sequence in accordance with an accompaniment signal sequence output from the video-song accompaniment apparatus.

These and other objects, features and advantages according to the present invention are provided by the accompaniment data format which is characterized as including a display flag for instructing display of lyrics information corresponding to a next displayed measure, a color conversion flag for instructing conversion between first and second colors so as to successively convert the color of the displayed lyrics from the first color to the second color, and an erasure flag for instructing erasure of all the lyrics of a present displayed measure.

These and other objects, features and advantages according to the present invention are provided by a video-song accompaniment apparatus. The inventive apparatus preferably includes an accompaniment information memory for storing accompaniment information following the Musical Instrument Digital Interface (MIDI) standard, a lyrics information memory for storing lyrics information, an accompaniment signal generator for generating an accompaniment signal based on the accompaniment information, a lyrics signal generator for generating a video signal based on the lyrics information, and a controller for controlling the generation of the lyrics signal in response to reproduction of the accompaniment signal.

According to one aspect of the present invention, lyric display control information is loaded on the accompaniment information stored in the accompaniment information memory. According to another aspect of the present invention, the lyrics display control information includes a display flag for instructing output of the lyrics signal sequence for the next measure to a lyrics signal generator, a color conversion flag for instructing conversion, successively, between first and second colors of a character of the lyrics information output to the lyrics signal generator, and an erasure flag for instructing erasure of the lyrics representing one measure output to the lyrics signal generator. An additional aspect of the present invention permits the controller to control lyrics display according to the lyrics display control information.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE PREFERRED EMBODIMENT

Figure 1:
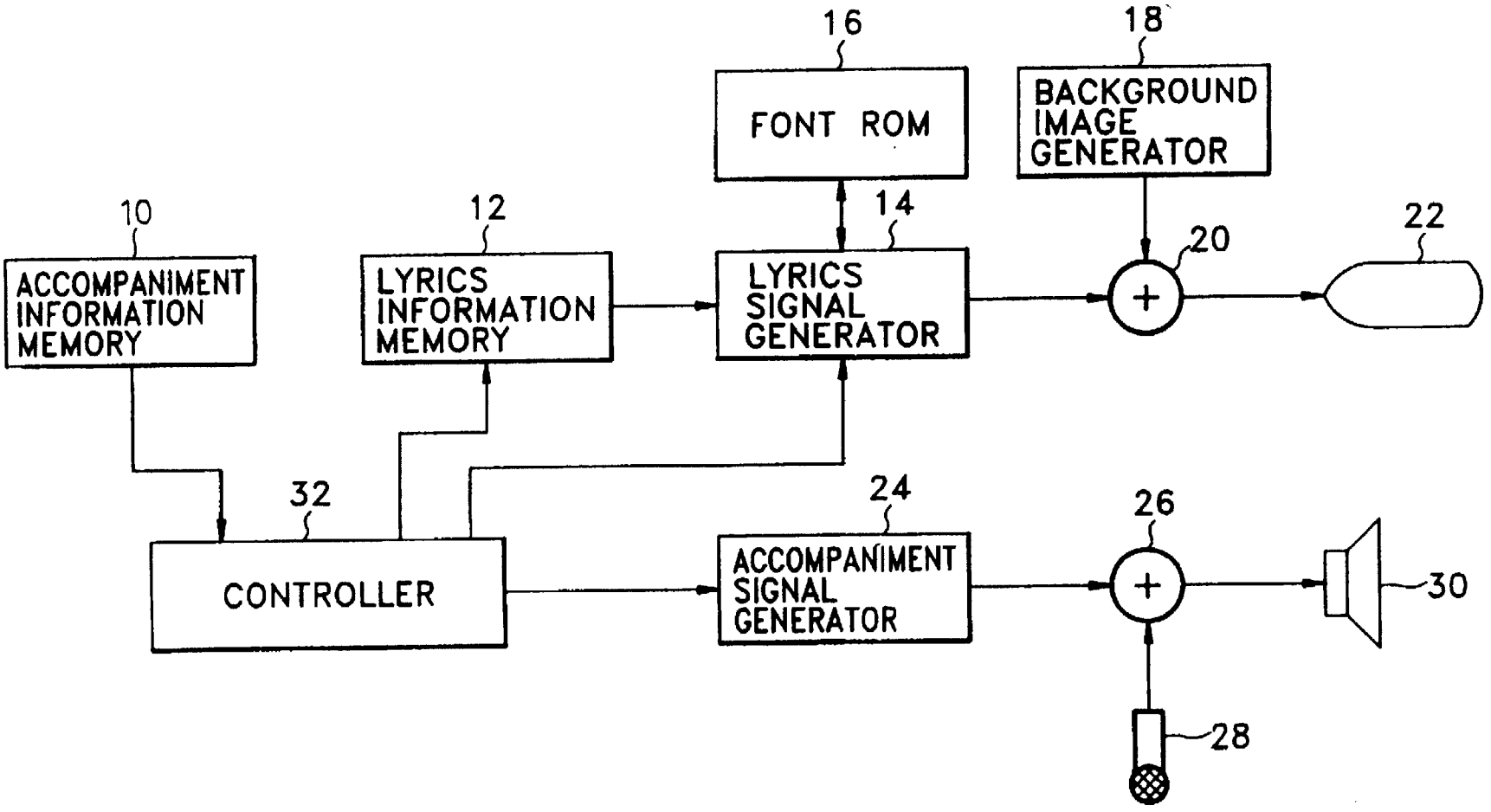
FIG. 1 is a high level block diagram illustrating a video-song accompaniment apparatus according to the present invention.

FIG. 1 is a block diagram illustrating a video-song accompaniment apparatus according to the present invention. As shown in FIG. 1, a controller 32 is connected to both an accompaniment information memory 10, which stores the accompaniment information of plural instruments according to the musical instrument digital interface (MIDI) standard, and a lyrics information memory 12 storing lyrics information. Preferably, the memory 10 may be a compact disk and in an exemplary case may be a so-called CD-ROM. It will also be noted that the lyrics information memory 12 can be any of the known types of semiconductor memories. Advantageously, memory 12 can be a non-volatile semiconductor memory.

A lyrics signal generator 14 converts and stores lyrics information received from the lyrics information memory 12 into a video signal having a bit map font and outputs the converted lyrics information as the lyrics signal sequence to a video mixer 20. Preferably, a font ROM 16 for storing a bit map font is operatively connected to signal generator 14. Video mixer 20 advantageously includes two input terminals, one connected to signal generator 14 and one connected to a background image generator 18, the latter generating a background image for display on monitor 22. In will be appreciated that video mixer 20 mixes a first video signal representing the lyrics signal sequence provided by lyrics signal generator 14 with a second video signal generated by background image generator 18.

Controller 32 is also connected to an accompaniment signal generator 24, which is used for generating an accompaniment signal based on the accompaniment information representing each instrument, which information is stored in memory 10. An audio mixer 26 mixes an accompaniment signal generated by accompaniment signal generator 24 with a voice signal generated by a microphone 28 and outputs this mixed acoustic signal to an output device, e.g., a speaker 30.

As discussed immediately above, controller 32 reads out the accompaniment information stored in accompaniment information memory 10 and provides the read signal to accompaniment signal generator 24. Preferably, controller 32 regulates the display of lyrics information by controlling both lyrics information memory 12 and lyrics signal generator 14. Advantageously, controller 32 controls memory 12 and generator 14 in accordance with lyrics display control information stored in accompaniment information memory 10, as discussed in greater detail below.

The accompaniment information is composed of MIDI data, i.e., a MIDI signal. Table 1 shows an exemplary MIDI signal data format.

TABLE 1

| | | STATUS BYTE | NUMBER OF DATA BYTES |
|---|---|---|---|
| CHANNEL MESSAGE | Note OFF | 8X | 2 |
| | Note ON | 9X | 2 |
| | Poly Phonic Key Pressure | AX | 2 |
| | Control Change | BX | 2 |
| | Program Pressure | CX | 1 |
| | Channel Pressure | DX | 1 |
| | Pitch Foil Change | EX | 2 |
| SYSTEM MESSAGE | Exclusive Change | F0 | arbitrary |
| | Cutter Frame Change | Fl | 1 |
| | Song Position Pointer | F2 | 2 |
| | Song Selector | F3 | 1 |
| | Tune Request | F6 | nonexistent |
| | End of Exclusive | F7 | nonexistent |
| | Timing Clock | F8 | nonexistent |
| | Start | FA | nonexistent |
| | Continue | FB | nonexistent |
| | Stop | FC | nonexistent |
| | Active Sensing | FE | nonexistent |
| | System Reset | FF | nonexistent |

The MIDI signal includes a "status byte", which, in an exemplary case, is one byte long and a respective "data byte", which, in the exemplary case under discussion, is more than one byte long. The MIDI signal is largely divided into a channel message and a system message in accordance with the status byte. The channel message is divided into a voice message and a mode message, while the system message is divided into an exclusive message, a common message, and a real-time message. An exemplary channel message, as shown in FIG. 2, indicates the start and stop of a note from a predetermined instrument, i.e., a channel, with a predetermined note tone and a predetermined stress.

Figure 2:
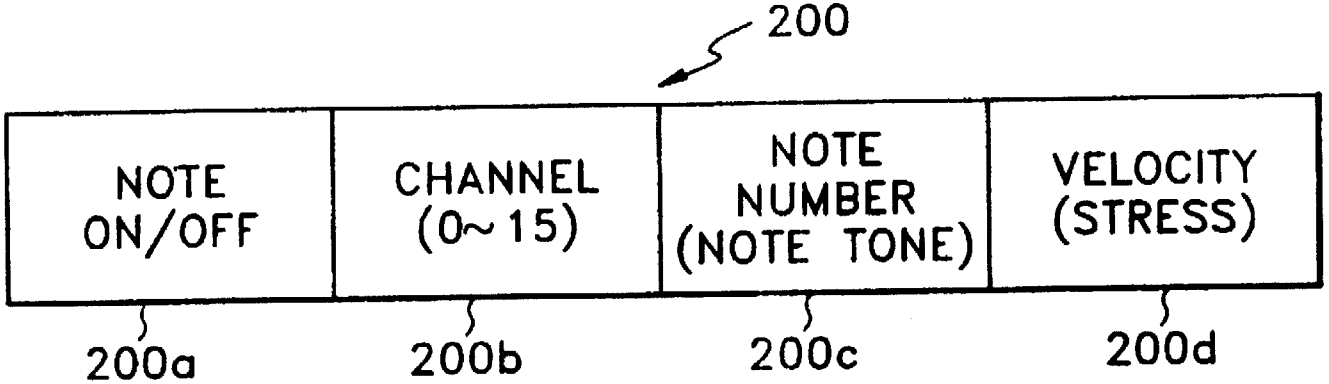
FIG. 2 is a view illustrating the contents of a channel message representing MIDI data.

FIG. 2 illustrates the data format of the channel message in the MIDI data, wherein the illustrated channel message 200 includes note on/off data 200*a*, channel data 200*b*, note number data 200*c*, and velocity data 200*d*. It should be noted that velocity is a term used in computer music to indicate the stress of a corresponding note.

Note on/off data 200*a* is a signal for controlling the turning on and off of a certain note of an instrument, which note is designated by channel data 200*b* and note number data 200*c*, following note on/off data 200*a*. With respect to the apparatus depicted in FIG. 1, channel data 200*b* determines both the instrument and the associated tone color of the accompaniment signal generated by accompaniment signal generator 24 in response to accompaniment information routed to signal generator 24 from memory 10 via controller 24. In an exemplary case, accompaniment signal generator 24 is a device such as a synthesizer, which has the capability of processing 16 to 32 channels; i.e., generating the sounds associated with 16 to 32 different instruments.

Referring again to FIG. 2, note number data 200*c* contains instructions representing the note tone of the instrument designated by channel data 200*b*, while velocity data 200*d* determines the stress of the designated note tone.

In the present invention, lyrics display control information is loaded on a selected channel message for the accompaniment information of a certain instrument instead of the usual accompaniment information. As will be discussed in greater detail below, the lyrics display control information advantageously permits control of the lyrics display on monitor 22.

Figure 3:
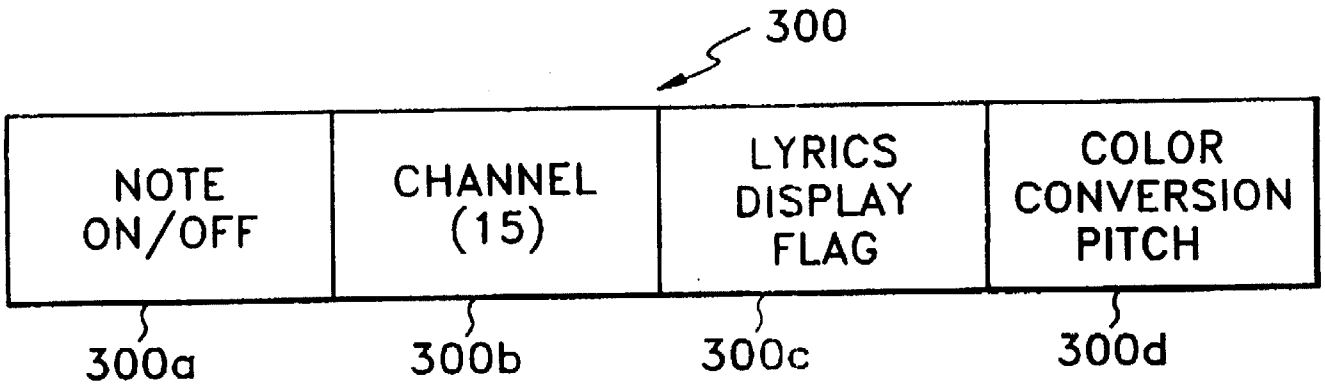
FIG. 3 is a view illustrating the contents of a channel message used for lyrics display control.

FIG. 3 depicts a channel message having lyrics display control information according to the present invention for an exemplary case where the designated channel is channel 15. It will be appreciated that other channels may be used for storage of lyrics display control information. As shown in FIG. 3, channel message 300 for lyrics display control is composed of note on/off data 300*a*, channel data 300*b*, lyrics display flag 300*c*, and color conversion pitch data 300*d*. Advantageously, the contents of lyrics display flag 300*c* can include:

(1) A display flag, which can be used for instructing the display of the characters of the portion of the lyrics signal sequence corresponding to a next measure of the accompaniment signal on the screen of monitor 22;

(2) A color conversion flag, which preferably provides instructions for the successive conversion of the characters corresponding to that portion of the lyrics signal sequence being currently displayed on the screen of monitor 22 from one color to another; and (3) An erasure flag, which can be used in instructing erasure of the characters of the portion of the lyrics signal sequence of a current measure being displayed on the screen of monitor 22.

The lyrics signal sequence in accordance with the accompaniment signal sequence advantageously can be displayed by locating channel message 300 used in controlling lyrics display control near to a note corresponding to the lyrics signal sequence. As will be explained in greater detail below, the display flag, the color conversion flag, and the erasure flag are employed for timing when parts of lyrics corresponding to a measure of a music, in most cases, are displayed. The display flag is positioned at the head of the accompaniment information for enabling the lyrics to be displayed on the screen. The color conversion flag enables the color of the characters in the displayed lyrics to be changed in time to the music. The erasure flag is positioned at the tail of the accompaniment information, to enable the removal of the lyrics after the color conversion of the displayed lyrics is finished. Accordingly, the sequence of operation of the aforementioned flags by controller 32 is; the display flag, the color conversion flag and the erasure flag.

Preferably, color conversion pitch data 300*d* determines the speed at which a character in the lyrics signal sequence is converted from one color to another. The character in the lyrics signal sequence output from lyrics signal generator 14 is a character signal of a bit map font where each character is composed of N×M pixels. Color conversion pitch data 300*d* determines the number of pixels converted per unit time in the color conversion process whereby one character is gradually changed from a first color to a second color. It should be mentioned that all pixels corresponding to the character under discussion can be changed from the first to the second color all at once.

By way of example, an accompaniment signal sequence can be controlled to closely match a lyrics signal sequence by decreasing the value of color conversion pitch data 300*d* when the corresponding character in the lyrics signal sequence corresponds to an accompaniment signal including many beats, and by increasing the value when many characters in the lyrics signal sequence correspond to one beat in the accompaniment sequence.

Figure 4:
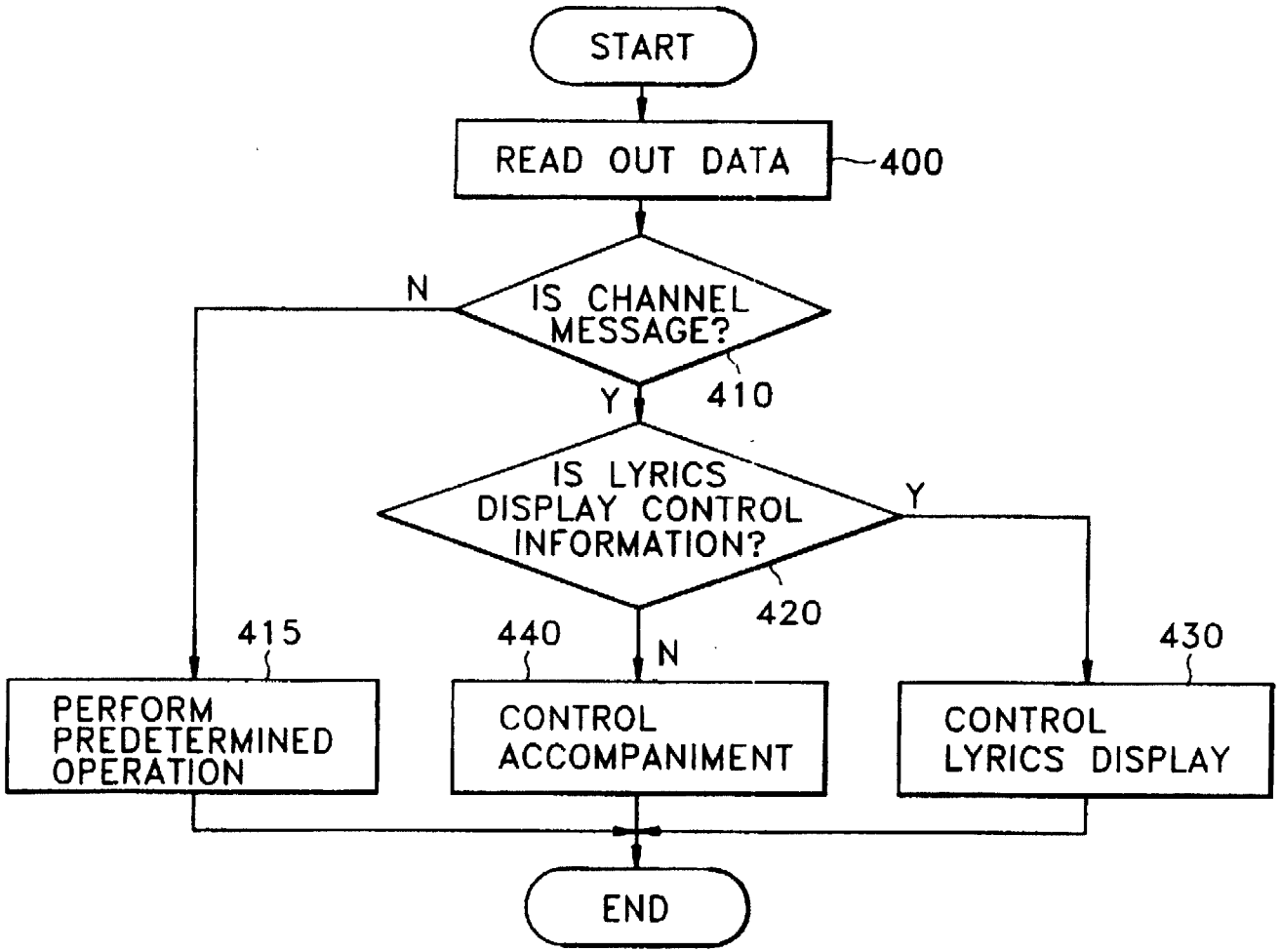
FIG. 4 is a flowchart which is useful in understanding the operating steps of the controller illustrated in FIG. 1.

FIG. 4 is a flow chart which is useful for explaining the operation of controller 32 illustrated in FIG. 1. Advantageously, the controller 32 primarily reads out the accompaniment information stored in accompaniment information memory 10, which information is needed in order to generate the accompaniment signal or to display one or more characters in a lyrics signal sequence, during in step 400. Controller 32 determines whether the read out data is a channel message in step 410. When the read out data is not a channel message, controller 32 performs the operation corresponding to the designated contents during step 415. However, when the data is a channel message, controller 32 then determines whether the channel message contains the lyrics display control information during step 420. Preferably, when the channel message is the lyrics display control information, controller 32 performs the designated lyrics display control operation by controlling lyrics information memory 12 and lyrics signal generator 14 in accordance with the contents of the lyrics display control flag 300*c*, as described above, during step 430. When the channel message is not the lyrics display control information, controller 32 transmits the accompaniment information to the accompaniment signal generator 24 during step 440, whereby accompaniment signal generator 24 generates an accompaniment signal according to the transmitted accompaniment information As described above, the video-song accompaniment apparatus according to the present invention permits control of the display of a lyrics signal sequence in parallel with the generation of an accompaniment signal by performing a lyrics display control using a channel message of the MIDI signal.

Other modifications and variations to the invention will be apparent to those skilled in the art from the foregoing disclosure and teachings. Thus, while only certain embodiments of the invention have been specifically described herein, it will be apparent that numerous modifications may be made thereto without departing from the spirit and scope of the invention.

What is claimed is:

1. An accompaniment data format of a video-song accompaniment apparatus having a controller reading accompaniment information contained in a first memory and controlling display and successive color conversion of a lyrics sequence stored in a second memory to thereby display a lyrics signal sequence synchronized with an accompaniment signal sequence, said accompaniment data format comprising:

a display flag for instructing display of a respective portion of the lyrics signal sequence corresponding to a respective next measure of the accompaniment signal sequence;

a color conversion flag for instructing successive conversion of respective characters in said displayed portion of the lyrics signal sequence from a first color to a second color; and an erasure flag for instructing erasure of a respective displayed potion of the lyrics signal sequence corresponding to a currently reproduced measure of the accompaniment signal sequence.

2. The accompaniment data format of a video-song accompaniment apparatus as set forth in claim 1, wherein said accompaniment information conforms to a Musical Instrument Digital Interface (MIDI) standard, and wherein said display flag, said color conversion flag, and said erasure flag are included in a channel message corresponding to a predetermined channel of said accompaniment information.

3. A video-song accompaniment apparatus, comprising:

an accompaniment information memory for storing accompaniment information following a Musical Instrument Digital Interface (MIDI) standard;

a lyrics information memory for storing corresponding lyrics information;

an accompaniment signal generator for generating an accompaniment signal sequence based on said accompaniment information;

a lyrics signal generator for generating a lyrics signal sequence based on said lyrics information; and a controller for controlling generation of said lyrics signal sequence in synchronization with reproduction of said accompaniment signal sequence, said controller controlling display of said lyrics signal sequence according to lyrics display control information;

wherein lyrics display control information is loaded onto said accompaniment information stored in said accompaniment information memory, and wherein said lyrics display control information includes a display flag for permitting output of a portion of said lyrics signal sequence corresponding to a next measure of said accompaniment signal sequence by said lyrics signal generator, a color conversion flag instructing said lyrics signal generator to successively convert characters of the respective displayed portion of said lyrics signal sequence from a first color to a second color, and an erasure flag permitting erasure the respective displayed portion of said lyrics signal sequence corresponding to a currently reproduced measure of said accompaniment signal sequence by said lyrics signal generator.

4. The video-song accompaniment apparatus as set forth in claim 3, wherein said lyrics display control information is loaded as a channel message corresponding to a predetermined instrument.

5. A method of operating a video-song accompaniment apparatus having an accompaniment information memory storing accompaniment information following a Musical Instrument Digital Interface (MIDI) standard, a lyrics information memory storing corresponding lyrics information, an accompaniment signal generator generating an accompaniment signal sequence based on the accompaniment information, a lyrics signal generator generating a video signal sequence based on the lyrics information, and a controller controlling generation of the lyrics signal sequence in synchronization with reproduction of the accompaniment signal sequence, the controller controlling display of the lyrics signal sequence according to lyrics display information embedded with the accompaniment information, said method comprising the steps of:

(a) reading a selected portion of the accompaniment information from an accompaniment information memory;

(b) examining said selected portion and determining whether said selected portion corresponds to a channel message;

(c) when said selected portion corresponds to said channel message, examining said channel message for lyrics display control information;

(d) when said channel message contains said lyrics display control information, controlling the lyrics signal generator to generate the video signal sequence, from said lyrics information stored in said lyrics information memory, in accordance with said lyrics display control information; and (e) when said channel message contains said accompaniment information, controlling the accompaniment signal generator to generate the accompaniment signal sequence in accordance with said accompaniment information.

6. The method of operating a video-song accompaniment apparatus as set forth in claim 5, wherein said step (d) comprises the steps of:

(d)(1) generating a portion of said lyrics signal sequence corresponding to a next measure of the accompaniment signal sequence, (d)(2) instructing the lyrics signal generator to successively convert characters included in a respective displayed portion of said lyrics signal sequence from a first color to a second color; and (d)(3) erasing a displayed portion of the lyrics signal sequence corresponding to a completely reproduced measure of said accompaniment signal sequence.

* * * * *